US005565880A

United States Patent [19]

Wang et al.

[11] Patent Number: 5,565,880

[45] Date of Patent: Oct. 15, 1996

[54] ANTENNA FOR PORTABLE TELECOMMUNICATION SYSTEMS

[75] Inventors: Ping Wang; Sigeru Uchino, both of Tokyo, Japan

[73] Assignee: Harada Kogyo Kabushiki Kaisha, Tokyo, Japan

[21] Appl. No.: 361,981

[22] Filed: Dec. 22, 1994

[51] Int. Cl.[6] ..... H01Q 9/04

[52] U.S. Cl. ..... 343/791; 343/790; 343/789

[58] Field of Search ..... 343/791, 790, 343/792, 789, 895, 713, 752, 866, 833, 834; H01Q 9/04

[56] References Cited

U.S. PATENT DOCUMENTS 4,183,027 1/1980 Ehrenspeck ..... 343/789

4,268,833 5/1981 Milne ..... 343/895

*Primary Examiner*—Hoanganh Le

*Attorney, Agent, or Firm*—Koda and Androlia

[57] ABSTRACT

A telecommunication system antenna including: a non-resonating three-wire type folded element which generates an unbalanced mode current and has a matching function; a sleeve element which consists of a conductive sleeve with its one end near the non-resonating three-wire type folded element and a conductive disk in a flange shape around the circumference of the other end of the conductive sleeve, so that the sleeve element radiates electromagnetic waves based on the unbalanced mode current generated by the non-resonating three-wire type folded element; and a coaxial line with its tip end inserted into the conductive sleeve of the sleeve element from the other end of the conductive sleeve so that the coaxial line is electrically connected to the conductive sleeve and to the non-resonating three-wire type folded element.

5 Claims, 5 Drawing Sheets

ANTENNA FOR PORTABLE TELECOMMUNICATION SYSTEMS

BACKGROUND OF THE INVENTION

1. Field of the Utilization

The present invention relates to an antenna for communication systems such as automobile telephones, portable telephones, etc. which is ideal as an antenna installed both indoors and outdoors.

2. Prior Art

When these types of antennas are installed on indoor ceilings, etc., they are eyesores if they are large, and it would be difficult to secure a location for installing such large antennas. Accordingly, antennas that are compact and light in weight which can be manufactured at a low cost are desired.

FIG. 5 shows one example of a conventional antenna of this type. The antenna shown in FIG. 5 is comprised of: a rod-form first antenna element 1 which has an electrical length of lambda/4 (where lambda is the wavelength of the electromagnetic waves in the frequency band used); a cylindrical second antenna element 2 which has an electrical length of lambda/4 and is installed at the base end of the first antenna element 1; and a coaxial line 3 with a tip end thereof inserted into the hollow interior of the second antenna element 2 so as to electrically connect the second antenna element 2 and the first antenna element 1.

The conventional antenna described above is a type of so-called "sleeve antenna" and has an electrical length of lambda/2. Accordingly, the total length of the antenna is great; and therefore, the antenna takes up considerable space. Accordingly, when an antenna is installed indoors, the antenna is a severe eyesore. In addition, it is difficult to secure a location where the antenna is installed. Furthermore, there are also problems with directivity.

SUMMARY OF THE INVENTION

The object of the present invention is to provide an antenna for telecommunication systems which is compact and light in weight, which can be easily and securely installed in any desired location such as an indoor ceiling, etc., without becoming an eyesore, which can be manufactured at low cost, and which has adequate characteristics for use as a base station antenna.

In order to solve the problems and achieve the object, the antenna for telecommunication systems of the present invention is constructed as shown below:

(1) The antenna for telecommunication systems of the present invention includes:

a non-resonating three-wire type folded element which generates an unbalanced mode current and exhibits a matching function, a sleeve element which consists of a conductive sleeve and a conductive disk, one end of the conductive sleeve being installed in close proximity to the non-resonating three-wire type folded element and the conductive disk being installed in a form of a flange around a circumference of another end of the conductive sleeve, so that the sleeve element radiates electromagnetic waves based on the unbalanced mode current generated by the non-resonating three-wire type folded element, and a coaxial line with a tip end of the coaxial line being inserted into the conductive sleeve of the sleeve element from another end of the conductive sleeve, so that the coaxial line is electrically connected to the conductive sleeve and the non-resonating three-wire type folded element.

(2) In addition, the antenna for telecommunication systems of the present invention is the antenna described above (1), and the non-resonating three-wire type folded element comprises: a ring-shaped member having a shape of a circular ring; a first linear member which extends from one point on an inner circumference of the ring-shaped member to a central portion of the ring-shaped member so as to be connected to a core conductor of the coaxial line, and a second linear member which, in a manner to correspond to the first linear member, extends from another point on the inner circumference of the ring-shaped member to a point near the central portion of the ring-shaped member so as to be connected to an outer conductor of the coaxial line.

(3) Furthermore, the antenna for telecommunication systems of the present invention is the antenna described above (1), and the antenna further includes an electromagnetic wave reflecting plate which has an annular shape, the reflecting plate being installed at another end of the conductive sleeve and separated from the conductive disk by a predetermined distance so that the electromagnetic wave reflecting plate faces the conductive disk.

As a result of the means described above, the present invention has the following effects:

(1) When the present invention is compared to the conventional example shown in FIG. 5, the non-resonating three-wire type folded element which generates an unbalanced mode current and acts as a matching element corresponds to the rod-form first antenna element 1 of the conventional example, and the sleeve element consisting of the conductive sleeve so as to radiate electromagnetic waves based on the unbalanced mode current generated and the conductive disk which is spread out in disk form at the other end (free end) of the conductive sleeve corresponds to the cylindrical second element 2 of the conventional example. Accordingly, the overall length of the antenna of the present invention can be reduced to approximately 30% of that of the conventional antenna that has a long, slender shape.

(2) The three members of the non-resonating three-wire type folded element, i.e., the ring-shaped member (having the shape of a circular ring), first linear member and second linear member, are within the same plane; that is, they form a flat plate shape as a whole. Accordingly, if the non-resonating three-wire type folded element and sleeve element are formed into an integral unit by fastening the central portion of the non-resonating three-wire type folded element to one end of the sleeve element via an insulating member, the amount of increase in the overall length of the antenna caused by the use of the non-resonating three-wire type folded element is only an amount that corresponds to the thickness of the non-resonating three-wire type folded element and the thickness of the insulating member. Accordingly, the shortening of the overall antenna length described in (1) above can be reliably achieved.

(3) The electromagnetic wave reflecting plate which has an annular shape is separated by a predetermined distance from the conductive disk of the sleeve element. Accordingly, the vertical-plane radiation pattern radiated from the conductive sleeve in the sleeve element is deflected away from the reflecting plate. Accordingly, even though the antenna is installed on an indoor ceiling with the non-resonating three-wire type folded element on the lower end and the reflecting plate on the upper end, the directivity of the antenna can be oriented several tens of degrees downward from the horizontal direction, and the gain is also improved. Thus, high-sensitivity transmission and reception can be performed between the antenna and the antenna of a portable telephone (mobile station) moving through the corresponding zone, securing appropriate communications.

The reflecting plate must be positionally separated from the conductive disk by a predetermined distance, and as a result, the length of the antenna is proportionally increased. However, since the total length is reduced to approximately 60% of that of the conventional antenna, the object of reduction in size is achieved.

DETAILED DESCRIPTION OF THE INVENTION

Figure 1A:
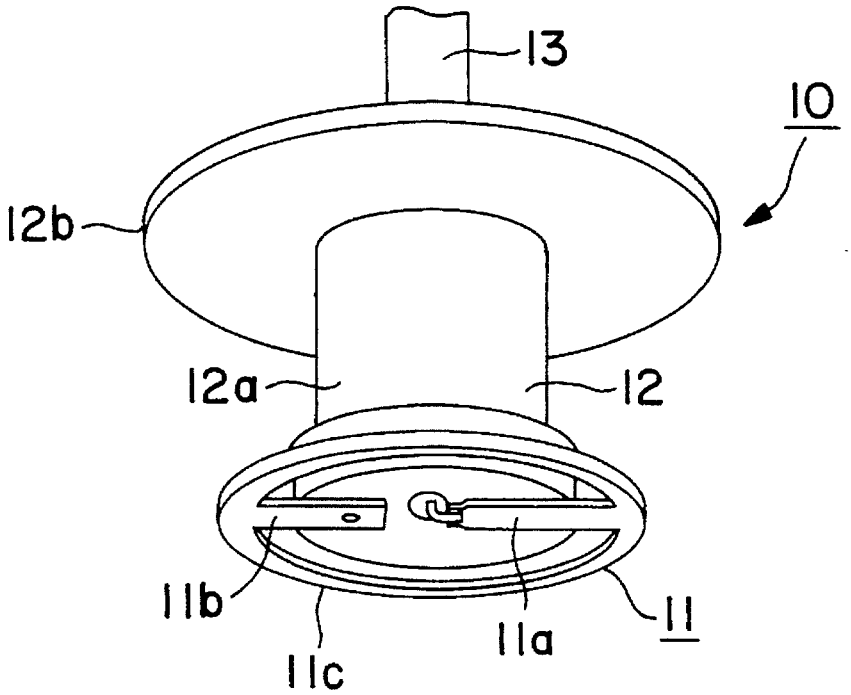
FIGS. 1*a*–1*b* are a perspective view and a sectional view which illustrate a telecommunication system antenna according to a first embodiment of the present invention.
Figure 1B:
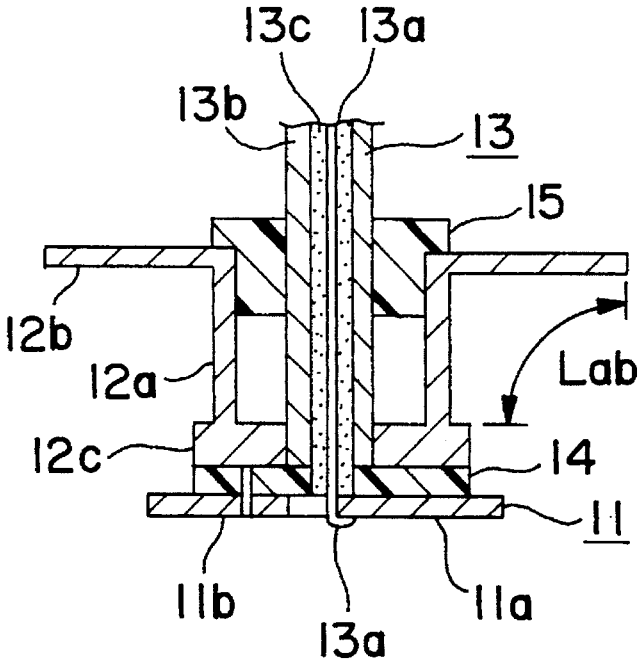

FIGS. 1*a* and 1*b* illustrate the structure of an antenna for telecommunication systems according to a first embodiment of the present invention. As shown in FIGS. 1*a* and 1*b*, the telecommunication system antenna 10 of this embodiment consists mainly of a non-resonating three-wire type folded element 11, a sleeve element 12, and a coaxial line 13.

The non-resonating three-wire type folded element 11 is comprised of a ring-shaped member 11*c*, a first linear member 11*a* and a second linear member 11*b*. The ring-shaped member 11*c* has a shape of a circular ring with a thickness of 0.2 to 0.3 mm and a diameter of approximately 0.15 to 0.2 lambda (in terms of electrical length). The first linear member 11*a* extends from one point on the inner circumference of the ring-shaped member 11*c* to the center of the ring-shaped member 11*c*. The second linear member 11*b* extends from another point on the inner circumference of the ring-shaped member 11*c* to a point near the center of the ring-shaped member 11*c*, so that the second linear member 11*b* faces the first linear member 11*a*. With this structure, the non-resonating three-wire type folded element 11 generates an unbalanced mode current and exhibits a matching function.

The sleeve element 12 is made of a conductive sleeve 12*a* with a diameter of approximately 0.03 to 0.06 lambda (in terms of electrical length) and a conductive disk 12*b* with a diameter of approximately 0.1 to 0.3 lambda (in terms of electrical length). One end (the bottom end in FIG. 1) of the conductive sleeve 12*a* is positioned in close proximity to the non-resonating three-wire type folded element 11, and the conductive disk 12*b* of a flange shape is located around the other end (the upper end in FIG. 1) of the conductive sleeve 12*a*. With this structure, the conductive sleeve element 12 radiates electromagnetic waves based on the unbalanced mode current generated by the non-resonating three-wire type folded element 11. The distance Lab (shown in FIG. 1*a*) that is from one end of the conductive sleeve 12*a* of the sleeve element 12 to the periphery of the conductive disk 12*b* is set to be an electrical length of approximately 0.25 lambda.

The tip end of the coaxial line 13 is inserted into the conductive sleeve 12*a* of the sleeve element 12 from the other end of the conductive sleeve 12*a*, and the coaxial line 13 is electrically connected to the conductive sleeve 12*a* and to the non-resonating three-wire type folded element 11. More specifically, the core conductor 13*a* of the coaxial line 13 is connected to the tip end of the first linear member 11*a* of the non-resonating three-wire type folded element 11, and the outer conductor 13*b* of the coaxial line 13 is connected to a point which is near the tip of the second linear member 11*b* of the non-resonating three-wire type folded element 11 via a cover 12*c* of the conductive sleeve 12*a*. The reference numeral 13*c* represents an insulator of the coaxial line 13.

An inner spacer 14 made from an insulating member with low dielectric loss characteristics is interposed between the non-resonating three-wire type folded element 11 and the cover 12*c* of the sleeve element 12. In addition, an outer spacer 15 made from an insulating member with low dielectric loss characteristics is interposed between the conductive disk 12*b* and the coaxial line 13.

It is preferable that the non-resonating three-wire type folded element 11, the sleeve element 12, the outer conductor 13*b* (of the coaxial line 13) and the electromagnetic wave reflecting plate 21 be formed from a material which has a small high-frequency resistance, e.g., brass, copper or aluminum, etc. These elements can be formed from a single material selected from such materials or from a combination of a multiple number of such materials.

It is desirable that the coaxial line insulator 13*c*, the outer spacer 14 and the inner spacer 15 be formed from a material with good insulating properties and a small dielectric loss, e.g., polytetrafluoroethylene, ABS resins, polyacetal resins, nylon, polycarbonate or polyurethane, etc. These elements can be formed from a single material selected from such materials or from a combination of a multiple number of such materials.

Figure 2A:
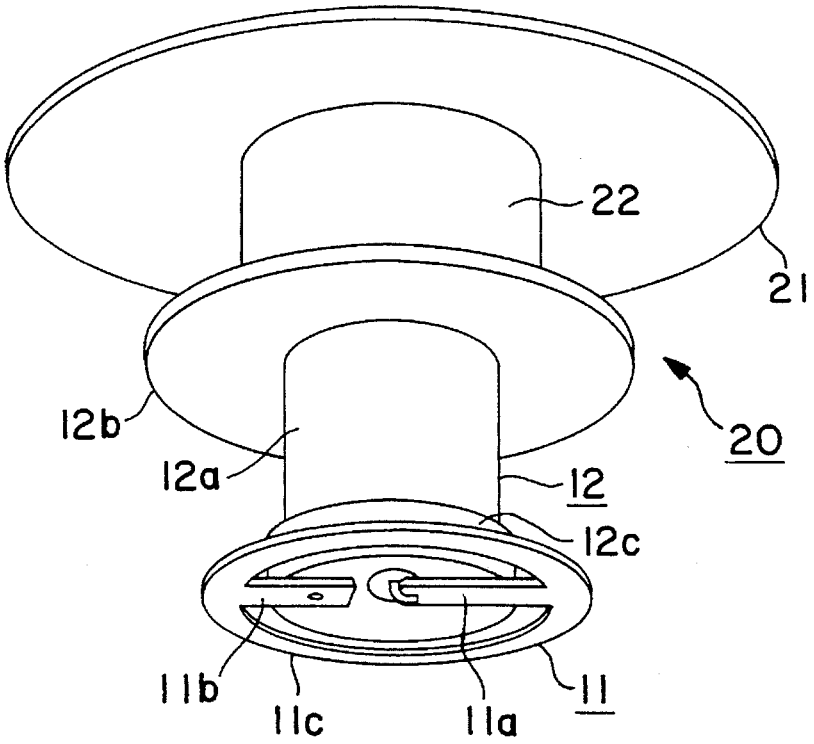
FIGS. 2*a*–2*b* are a perspective view and a sectional view which illustrate a telecommunication system antenna constituting a second embodiment of the present invention.
Figure 2B:
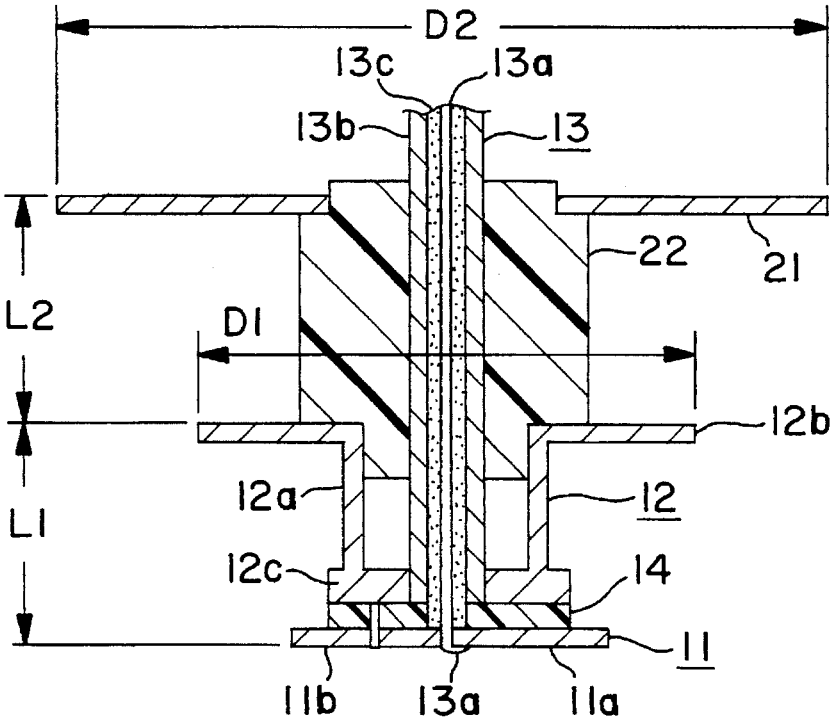

FIGS. 2*a* and 2*b* illustrate the structure of an antenna for telecommunication systems according to a second embodiment of the present invention. The telecommunication antenna 20 of the embodiment illustrated in FIGS. 2*a* and 2*b* differs from the antenna 10 of the first embodiment illustrated in FIGS. 1*a* and 1*b* in that the antenna 20 has an electromagnetic wave reflecting plate 21 of a prescribed diameter so that the reflecting plate 21 faces the conductive disk 12*b*. The reflecting plate 21 is in an annular shape and fitted over the circumference of the coaxial line 13 so that it is positionally separated from the flange-form conductive disk 12*b* by a predetermined distance L2.

The electromagnetic wave reflecting plate 21 is in an annular shape and made from a conductive material which has a thickness of 0.2 to 0.3 mm. The distance L2 by which the electromagnetic wave reflecting plate is separated from the conductive disk 12*b* is an electrical length of approximately the same as the diameter of the conductive disk 12*b* (0.1 to 0.3 lambda). Furthermore, the diameter D2 of the electromagnetic wave reflecting plate 21 is set to be an electrical length which is approximately 1.5 times the distance L2, i.e., approximately 0.5 to 2.0 lambda. A connecting spacer 22 made of an insulating material with low dielectric loss characteristics (which is the same material as the inner spacer 15 shown in FIG. 1) is interposed between the conductive disk 12*b*, electromagnetic wave reflecting plate 21 and coaxial line 13.

Figure 3A:
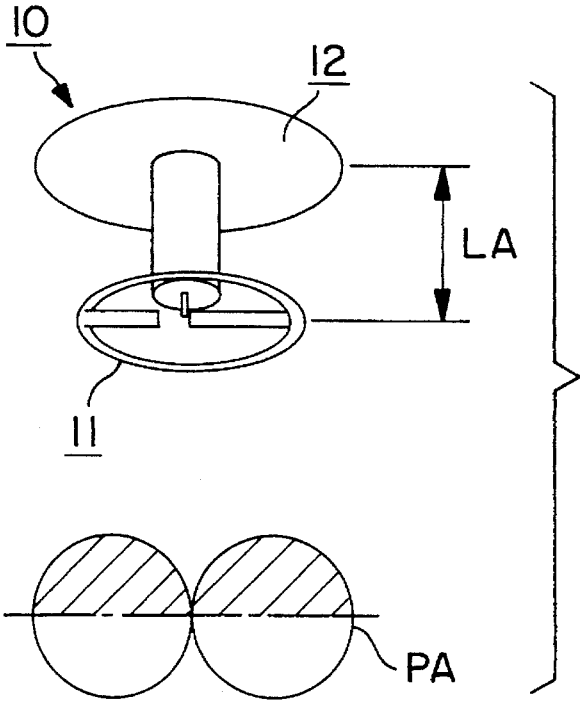
FIGS. 3*a*–3*b* are explanatory diagrams of the effect of the invention, which compare the antenna of the first embodiment illustrated in FIG. 1 with the antenna of the second embodiment illustrated in FIG. 2.
Figure 3B:
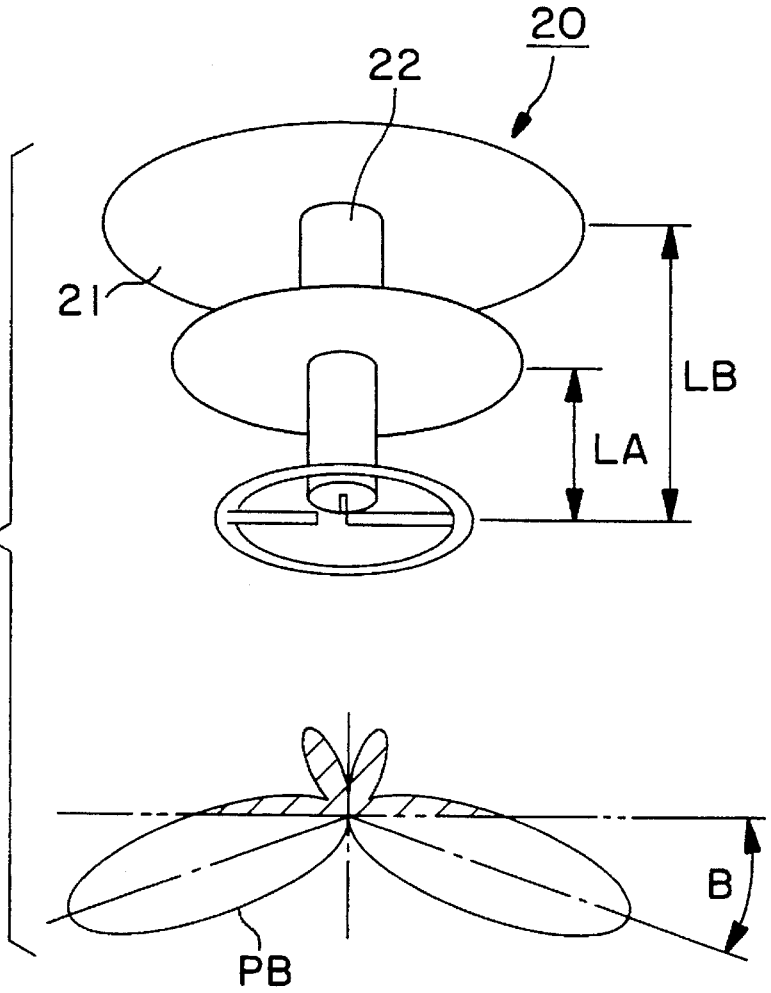

FIGS. 3*a* and 3*b* are explanatory diagrams of the effect of the present invention, comparing the antenna 10 of the first embodiment illustrated in FIG. 1 with the antenna 20 of the second embodiment illustrated in FIG. 2.

In the antenna 10, as shown in FIG. 3*a*, the total antenna length LA is approximately equal to the sum of the length of the sleeve element 12 and the thickness of the non-resonating three-wire type folded element 11. Accordingly, in a case where the frequency used is 1.9 GHz, the total antenna length LA is only about 25 mm. Furthermore, the vertical-plane radiation pattern PA has the shape as shown in FIG. 3*a*. Accordingly, if the antenna 10 is mounted to an indoor ceiling in the configuration shown in the Figure, the upper half of the vertical-plane radiation pattern PA (i.e., the portion indicated by oblique lines) will be blocked by the ceiling so that the radiation is ineffective. Accordingly, the directivity is somewhat poor, and the gain is also relatively small.

In the case of the antenna 20, as shown in FIG. 3*b*, the total antenna length LB is equal to the value that is obtained by adding the sum of the length of the connecting spacer 22 and the thickness of the reflecting plate 21 to the total antenna length LA shown in FIG. 3*a*. Accordingly, if the frequency used is 1.9 GHz, the total antenna length LB would be approximately 50 mm, and the vertical-plane radiation pattern PB has the shape shown in FIG. 3*b*. Accordingly, when the antenna 20 is mounted to an indoor ceiling in the configuration shown in the Figure, only an extremely small portion of the upper part of the vertical-plane radiation pattern (i.e., the oblique-lined portion) is ineffective, and most of the pattern acts effectively. As a result, the directivity is oriented downward by an angle of only theta (e.g., approximately 20 degrees), and the gain is also relatively large.

Figure 4A:
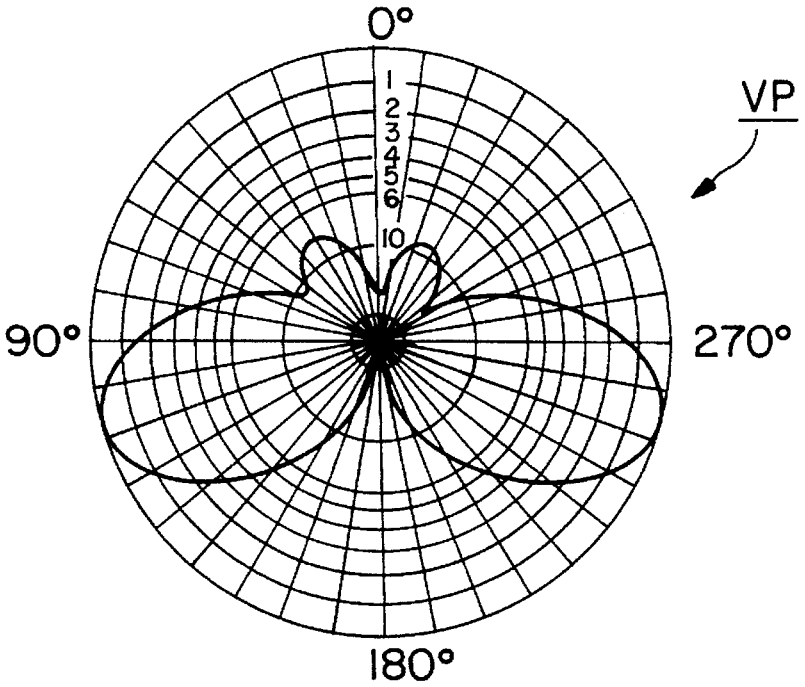
FIGS. 4*a*–4*b* are pattern diagrams which show the results obtained when the vertical-plane radiation pattern VP and horizontal-plane radiation pattern HP were measured for an antenna having the same structure as the antenna of the second embodiment illustrated in FIG. 2.
Figure 4B:
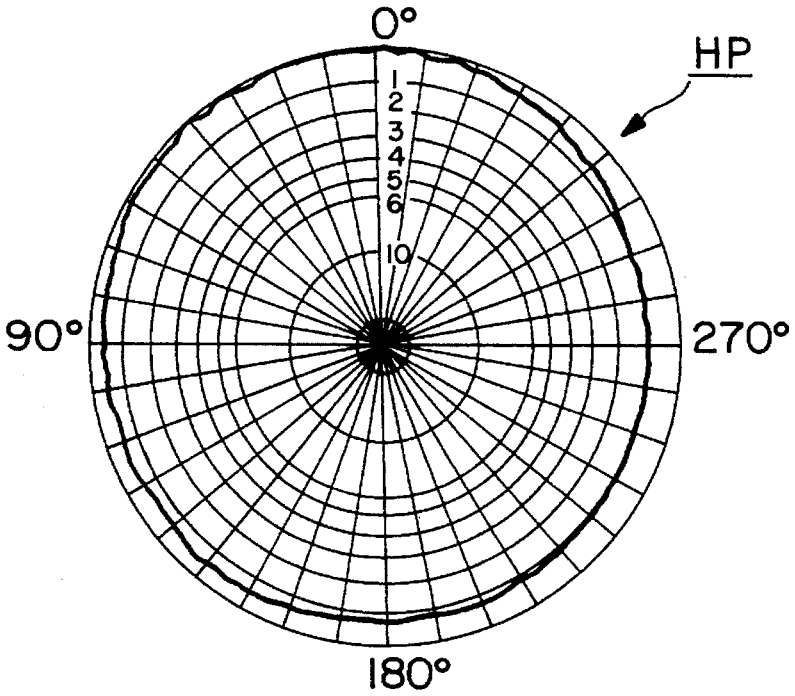

FIGS. 4*a* and 4*b* show pattern diagrams of the results obtained when the vertical-plane radiation pattern VP and horizontal-plane radiation pattern HP were measured for an antenna that has the same structure as the antenna 20. The measurement conditions used in these actual measurements were as follows:

a. Frequency used: 1.9 GHz b. Diameter of electromagnetic Wave reflecting plate 21: 130 mm As seen from FIG. 4*a*, the vertical-plane radiation pattern VP is desirable as illustrated in FIG. 3*b*. In addition, as shown in FIG. 4*b*, the horizontal-plane radiation pattern HP is also ideal with a roughly circular shape.

The structures and effects of the embodiments described above may be summarized as follows:

(1) The telecommunication system antennas 10 and 20 described in the first and second embodiments above each include: a non-resonating three-wire type folded element 11 which generates an unbalanced mode current and exhibits a matching function; a sleeve element 12 for radiating electromagnetic waves based on the unbalanced mode current generated by the non-resonating three-wire type folded element 11, the sleeve element consisting of a conductive sleeve 12*a* having one end thereof positioned near the non-resonating three-wire type folded element 11 and a conductive disk 12*b* being in the form of a flange around the circumference of the other end of the conductive sleeve 12*a*; and the coaxial line 13 with the tip end thereof inserted into the conductive sleeve 12*a* of the sleeve element 12 from the other end of the conductive sleeve 12*a* and electrically connected to the conductive sleeve 12*a* and the non-resonating three-wire type folded element 11.

Figure 5:
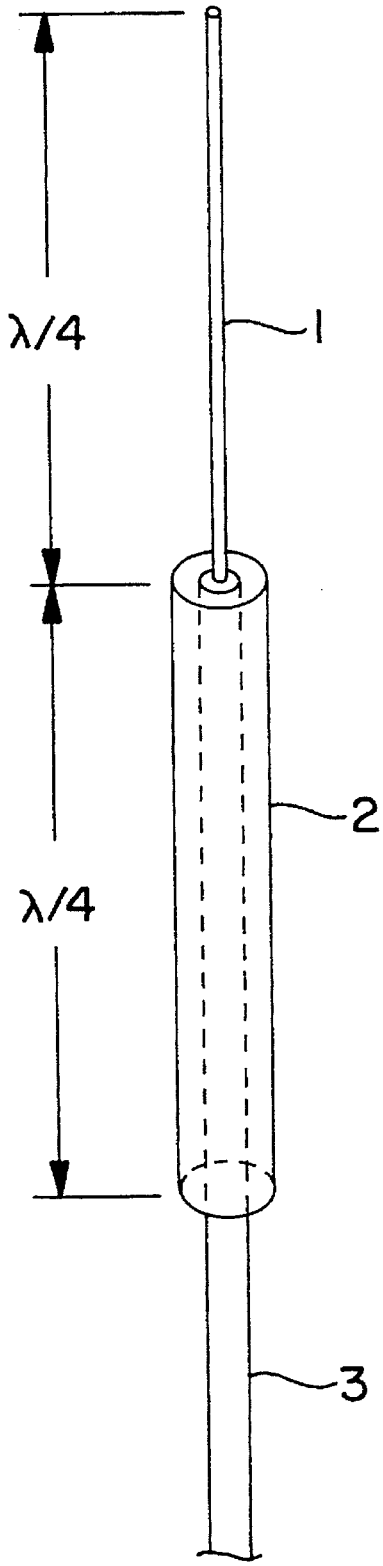
FIG. 5 PRIOR ART
FIG. 5 is a schematic perspective view which illustrates the structure of a conventional example.

Accordingly, when the antennas 10 and 20 are compared with the conventional example illustrated in FIG. 5, two things are clear: One is that the non-resonating three-wire type folded element 11 that generates an unbalanced mode current and acts as a matching element corresponds to the rod-form first antenna element 1 of the conventional example; and the other is that the sleeve element 12 consisting of the conductive sleeve 12*a* which radiates electromagnetic waves based on the unbalanced mode current and the conductive disk 12*b* which is in a disk extending from the other end (free end) of the conductive sleeve 12*a* corresponds to the cylindrical second element 2 of the conventional example. Accordingly, the overall length of the antenna can be smaller at approximately 50% of that of the conventional antenna having a long, slender shape.

(2) The telecommunication system antennas 10 and 20 described in the first and second embodiments are as described in (1) above, and the non-resonating three-wire type folded element 11 used therein is comprised of: the ring-shaped member 11*c* which has the shape of a circular ring; the first linear member 11*a* which extends from one point on the inner circumference of the ring-shaped member 11*c* to the central portion of the ring-shaped member 11*c* and is connected to the core conductor 13*a* of the coaxial line 13; and the second linear member 11*b* which extends from another point on the inner circumference of the ring-shaped member 11*c* to the central portion of the ring-shaped member 11*c* so that the second linear member 11*b* faces the first linear member 11*a* and is electrically connected to the outer conductor 13*b* of the coaxial line 13.

In other words, the three members of the non-resonating three-wire type folded element 11, which are the ring-shaped member 11*c*, the first linear member 11*a*, and the second linear member 11*b*, are installed on the same plane. In other words, these three members form a flat plate. Consequently, if the non-resonating three-wire type folded element 11 and the sleeve element 12 are formed into an integral unit by fastening the central portion of the non-resonating three-wire type folded element 11 to the sleeve element 12 via an insulating member, the amount of increase in the overall length of the antenna caused by the installation of the non-resonating three-wire type folded element 11 is only an amount that corresponds to the combined thickness of the non-resonating three-wire type folded element 11 and the insulating member. Thus, the shortening of the overall antenna length described in (1) above can be reliably achieved.

(3) The telecommunication system antenna 20 of the second embodiment is further includes the electromagnetic wave reflecting plate 21. The reflecting plate 21 has an annular shape and installed at the end of the conductive sleeve 12*a* with the distance L2 away from the conductive disk 12*b* in a manner that the electromagnetic wave reflecting plate 21 faces the conductive disk 12*b*.

Accordingly, the vertical-plane radiation pattern VP radiated from the conductive sleeve 12*a* in the sleeve element 12 is deflected away from the reflecting plate 21. As a result, if the antenna 20 is attached to, for example, an indoor ceiling with the non-resonating three-wire type folded element 11 on the lower end and the reflecting plate 21 on the upper end, the directivity of the antenna will be oriented several tens of degrees downward from the horizontal direction, and the gain will also be improved. Thus, high-sensitivity transmission and reception can be performed, and appropriate communications are possible.

The reflecting plate 21 is installed in a position separated from the conductive disk 12*b* by a predetermined distance L2, and this renders the length of the antenna 20 to be correspondingly increased. However, the total length can still be reduced to approximately 80% of that of the conventional example, so that the object of size reduction can be sufficiently achieved.

(4) The telecommunication system antenna 20 is as described in (3) above, and the distance L2 by which the electromagnetic wave reflecting plate 21 is separated from the conductive disk 12*b* is approximately the same as the diameter of the conductive disk 12*b* in terms of electrical length, and the diameter of the electromagnetic wave reflecting plate 21 is set to be 1.5 times the distance L2 or greater in terms of electrical length.

Accordingly, the electromagnetic waves radiated from the sleeve element 12 are effectively reflected by the electromagnetic wave reflecting plate 21. As a result, the vertical-plane radiation pattern VP is deflected under more or less ideal conditions. Though the reason why desirable results are obtained when the dimensions of the various elements are set in the ranges of the numerical values described above is unclear, the above results were obtained as a result of repeated experiments performed by the inventors of this application.

(5) The telecommunication system antenna 10 is as described in (1) above, and the inner spacer 15 made of an insulating material with a low dielectric loss is interposed between the conductive disk 12*b* and coaxial line 13.

Accordingly, the positional relationship between the conductive disk 12*b* and the coaxial line 13 can be stably kept over a long period of time by the spacer 15, and there is no occurrence of rattling among the elements even during long-term use. Thus, the antenna characteristics can be stably maintained.

(6) The telecommunication system antenna 20 is as described in (3) above, and the connecting spacer 22 made of an insulating material with a low dielectric loss is interposed between the conductive disk 12*b*, electromagnetic wave reflecting plate 21 and coaxial line 13.

Accordingly, the positional relationship of the conductive disk 12*b*, electromagnetic wave reflecting plate 21 and coaxial line 13 can be stably kept over a long period of time by the spacer 22. As a result, even during long-term use, there is no occurrence of rattling among the various elements, and the antenna characteristics can be stably maintained.

(7) The telecommunication system antennas of the present invention include the following modifications:

Though the antennas of the embodiments above are installed on an indoor ceiling, an outdoor installation would also be possible. In such cases, the antenna may be attached to a supporting arm which is installed on a supporting column so that the antenna faces a prescribed orientation.

An appropriate protective cover may be installed in order to prevent the adhesion of dust or water droplets.

The present invention provides an antenna for telecommunication systems, which is compact and light in weight, which can be easily and securely installed in any desired location such as an indoor ceiling, etc. without being an eyesore, which can be manufactured at low cost, and which has sufficient characteristics for use as a base station antenna.

We claim:

1. An antenna for portable telecommunication systems comprising:

a non-resonating three-wire type folded element which is installed so as to generate an unbalanced mode current and to exhibit a matching function, said non-resonating three-wire type folded element comprising a ring-shaped member, a first linear member which extends from one point on an inner circumference of said ring-shaped member to a center portion of said ring-shaped member, and a second linear member which extends collinearly to said first linear member from another point opposite to said one point on said inner circumference of said ring-shaped member to a point near said center portion of said ring-shaped member, a sleeve element which consists of a conductive sleeve smaller in diameter than said ring member and a conductive disk larger in diameter than said ring member so that said sleeve element radiates electromagnetic waves based on the unbalanced mode current generated by said non-resonating three-wire type folded element, one end of said conductive sleeve being in close proximity to said non-resonating three-wire type folded element and said conductive disk being in a form of a flange provided around a circumference of another end of said conductive sleeve, and a coaxial line with a tip end of said coaxial line being inserted into said conductive sleeve of said sleeve element from another end of said conductive sleeve, said coaxial line being electrically connected to said conductive sleeve and said first linear conductive member of said non-resonating three-wire type folded element.

2. An antenna for telecommunication systems according to claim 1, further comprising an electromagnetic wave reflecting plate larger in diameter than said conductive disk which has an annular shape, said reflecting plate being at another end of said conductive sleeve and apart from said conductive disk by a predetermined distance so that said electromagnetic wave reflecting plate faces said conductive disk.

3. An antenna according to claim 2, further comprising a dielectric spacer provided between said conductive disk and said reflecting plate.

4. An antenna according to claim 3, wherein said diameter of said conductive disk and said predetermined distance are equal and said diameter of said reflecting plate is 1½ times the diameter of said conductive disk.

5. An antenna according to claim 4, wherein said diameter of said conductive disk is 0.1 to 0.3 lambda, wherein lambda is the electrical wavelength of a frequency band used.

* * * * *